US006360734B1

(12) United States Patent
Andrews

(10) Patent No.: US 6,360,734 B1
(45) Date of Patent: Mar. 26, 2002

(54) ARCHERY BOW LIMB MOUNTING ASSEMBLY

(75) Inventor: Albert A. Andrews, Cleveland, TN (US)

(73) Assignee: High Country Archery, Inc., Dunlap, TN (US)

( * ) Notice: Subject to any disclaimer, the term of this patent is extended or adjusted under 35 U.S.C. 154(b) by 0 days.

(21) Appl. No.: 09/587,824

(22) Filed: Jun. 6, 2000

(51) Int. Cl.[7] ..... F41B 5/00
(52) U.S. Cl. ..... 124/23.1; 124/25.6
(58) Field of Search ..... 124/23.1, 24.1, 124/25.6, 86, 88

(56) References Cited

U.S. PATENT DOCUMENTS

| | | | | | |
|---|---|---|---|---|---|
| 4,793,319 | A | * | 12/1988 | Vaughan et al. | 124/25.6 |
| 5,231,970 | A | * | 8/1993 | Ploot et al. | 124/23.1 |
| 5,339,790 | A | * | 8/1994 | Smith | 124/25.6 |
| 5,411,008 | A | * | 5/1995 | Hsu | 124/23.1 |
| 5,433,792 | A | * | 7/1995 | Darlington | 124/25.6 |
| 5,487,373 | A | * | 1/1996 | Smith | 124/23.1 |
| 5,515,836 | A | * | 5/1996 | Martin et al. | 124/23.1 |
| 5,720,267 | A | * | 2/1998 | Walk | 124/23.1 |

* cited by examiner

*Primary Examiner*—John A. Ricci
(74) *Attorney, Agent, or Firm*—Reising, Ethington, Barnes, Kisselle, Learman & McCulloch, P.C.

(57) ABSTRACT

A connector for adjustably mounting a limb of a compound archery bow to a riser of the bow has a connector, a first washer with a sliding surface and a guide surface complementary to and received against the sliding surface and permitting the first washer to pivot in substantially any direction relative to the connector. In assembly, a threaded shank of the connector is received in a threaded blind bore in the riser and a head of the connector traps the first washer against the limb. The connector may be loosened or backed out of the riser to permit adjustment of the orientation of the limb relative to t he riser to thereby adjust the draw weight of the bow. As the orientation of the limb is changed, the orientation of the first washer relative to the connector is likewise changed without changing the orientation of the connector to limit the bending or lateral forces applied to the connector and prevent it from being sheared or otherwise failing. Preferably, an insert which defines the guide surface is disposed within a recessed sliding surface of the washer between the washer and the head of the connector and is complementarily shaped to the recess to permit angular or pivotal movement of the first washer relative to the connector in substantially any direction.

20 Claims, 3 Drawing Sheets

ARCHERY BOW LIMB MOUNTING ASSEMBLY

FIELD OF THE INVENTION

This invention relates generally to archery bows and more particularly to compound archery bows and a system for mounting limbs to a riser of the bow.

BACKGROUND OF THE INVENTION

Compound archery bows having a handle or riser portion with a pair of limbs extending from opposed sides or ends of the riser are well known. Typically to connect the limbs to the riser, a bolt or connector extends through the limb and into the riser.

After assembly of the bow, with the limbs under tension, it may be desirable to change the draw weight or force required to pull a draw string of the bow to its fully drawn position. To do this, the bow may be disassembled and a bow string of a different length provided to change the initial flex of the bow limbs, or the cap screw connecting the limbs to the riser may be loosened or backed out slightly to change the orientation of the limb relative to the riser and thereby change the initial loading of the limb. Notably, significant shearing forces are exerted on the bolt as the orientation of the limb relative to the riser is changed which greatly limits the degree to which the connector may be backed out or adjusted without shearing or breaking the connector. Therefore, the draw weight of a bow with only a connector extending through the limb and into the riser can only be adjusted a very minimal amount, if at all, after assembly of the bow.

In some bows, a separate steel, cylindrical pin is provided in the riser for each limb and threadedly receives the end of the connector extending through its associated limb and into the riser. The pins can pivot or rotate relative to the riser only in a single plane generally transverse to the axis of the pin to permit some relative pivotal movement of the connectors relative to the riser. This limits the shearing forces on the connectors within a limited range when they are backed out to adjust the draw weight of the bow. With the addition of the pins, the draw weight of the bow may be adjusted over a somewhat wider although still very limited range after assembly of the bow as compared to a compound bow without any pins.

The pins are generally cylindrical, formed of steel for high strength and are received in complementary bores in the riser and may each weigh up to one ounce or more which undesirably adds to the weight of the bow. Notably, the pins and the bores in the riser which receive them must be very accurately located in the riser to achieve their intended purpose. This increases the time and cost to manufacture and assemble the bow. Still further, the total range of adjustment of the draw weight of the bow is still limited even with the pins wherein the relative movement between the connectors and the limbs occurs at the end of the connectors within the riser and pin. Undesirably, each connector is received in a threaded blind bore in its pin which reduces the number of threads of the connector that are received in and retained by the riser. Accordingly, the extent to which the connector can be backed out to change the bow draw weight without stripping the connector or the threads in the bore of the pin, is limited.

SUMMARY OF THE INVENTION

A connector for adjustably mounting a limb of a compound archery bow to a riser of the bow has a connector, a first washer with a sliding surface and a guide surface complementary to and received adjacent to the sliding surface of the first washer and permitting the first washer to pivot in substantially any direction relative to the connector. In assembly, a threaded shank of the connector is received in a threaded blind bore in the riser and a head of the connector traps the first washer between the connector and the limb. The connector may be loosened or backed out of the riser to permit adjustment of the orientation of the limb relative to the riser to reduce the degree to which the limb is initially flexed and thereby adjust the draw weight of the bow. As the orientation of the limb is changed, the orientation of the first washer relative to the connector is likewise changed without changing the axial orientation of the connector or bending it which limits the shearing forces applied to L the connector and prevents it from being sheared or otherwise failing. Preferably, an insert which defines the guide surface is disposed within a generally concave recess of the washer between the washer and the head of the connector and is complementarily shaped to the recess to permit angular or pivotal movement of the first washer relative to the connector in substantially any direction.

The first washer preferably has a flat face adjacent to and preferably fully engaged by or flush against the limb of the bow in assembly. As the connector is displaced relative to the riser such that the orientation or position of the limb relative to the riser is changed, the flat face of the washer is maintained flush against the limb and the washer pivots with the limb relative to the connector to avoid placing undue stress on the connector. With this arrangement, the draw weight of the bow may be changed over a wide range without breaking or putting undue stress on the connector. If desired, a flat, annular second washer may be disposed between the limb and the washer. The second washer may be formed of a generally resilient or ductile material to reduce vibrations of the bow in use, and prevent damage to the limbs from the first washer. Alternatively, the head of the connector may defame the guide surface and may be shaped complementary to the sliding surface of the first washer to permit the first washer to pivot relative to the head of the cap screw without any insert between them.

Objects, features and advantages of this invention include providing a compound bow with a connector assembly for mounting the limbs of the bow to the riser which facilitates adjustment of the draw weight of the bow, permits the draw weight of the bow to be adjusted over a wide range after assembly of the bow, reduces the overall weight of the bow, prevents undue stress from being applied to a connector attaching the limb to the riser, provides improved engagement of the connector with the riser to more securely mount the limbs to the risers, eliminates pivoting of the connector relative to the riser, is of relatively simple design and economical manufacture and assembly and has a long, useful life in service.

BRIEF DESCRIPTION OF THE DRAWINGS

These and other objects, features and advantages of this invention will be apparent from the following detailed description of the preferred embodiments and best mode, appended claims and accompanying drawings in which:

DETAILED DESCRIPTION OF THE PREFERRED EMBODIMENTS

Figure 1:
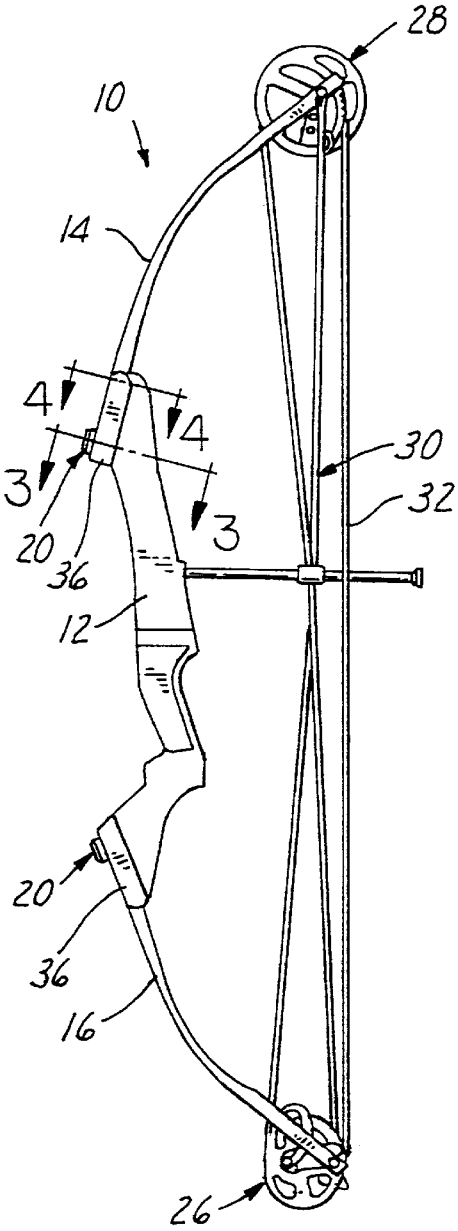
FIG. 1 is a side view of a compound bow having a pair of limbs each mounted to a riser by a connector assembly according to the present invention.

Referring in more detail to the drawings, FIG. 1 illustrates a compound archery bow 10 having a handle or riser 12 with a pair of limbs 14, 16 extending from opposed ends of the riser 12 each attached thereto at one end by a connector assembly 20 (FIGS. 2 and 3) having a connector such as a cap screw 22 and a pivotable washer 24 which permits adjustment of the orientation of the limbs 14, 16 relative to the riser 12 after assembly of the bow 10 to adjust the initial loading of the limbs or, in other words, the degree to which they are initially flexed. A cam 26 and wheel 28, or a pair of cams without a wheel, may be fixed to the free ends of the limbs 14, 16 in a known manner with one or more strings or cables 30 extending between the cams or wheels and the free ends of the limbs. A drawstring portion 32 of a string or cable is drawn away from the riser 12 to flex the free ends of the limbs 14, 16 inwardly towards each other, to store energy within the limbs 14, 16 which is released upon release of the drawstring portion 32, to shoot an arrow releasably coupled to the drawstring.

Figure 3:
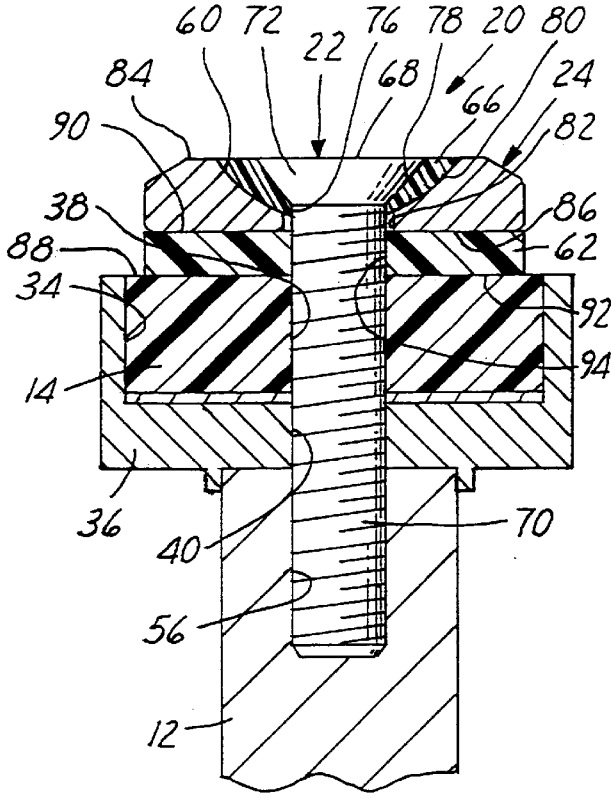
FIG. 3 is an enlarged fragmentary sectional view taken generally along line 3—3 of FIG. 1.
Figure 2:
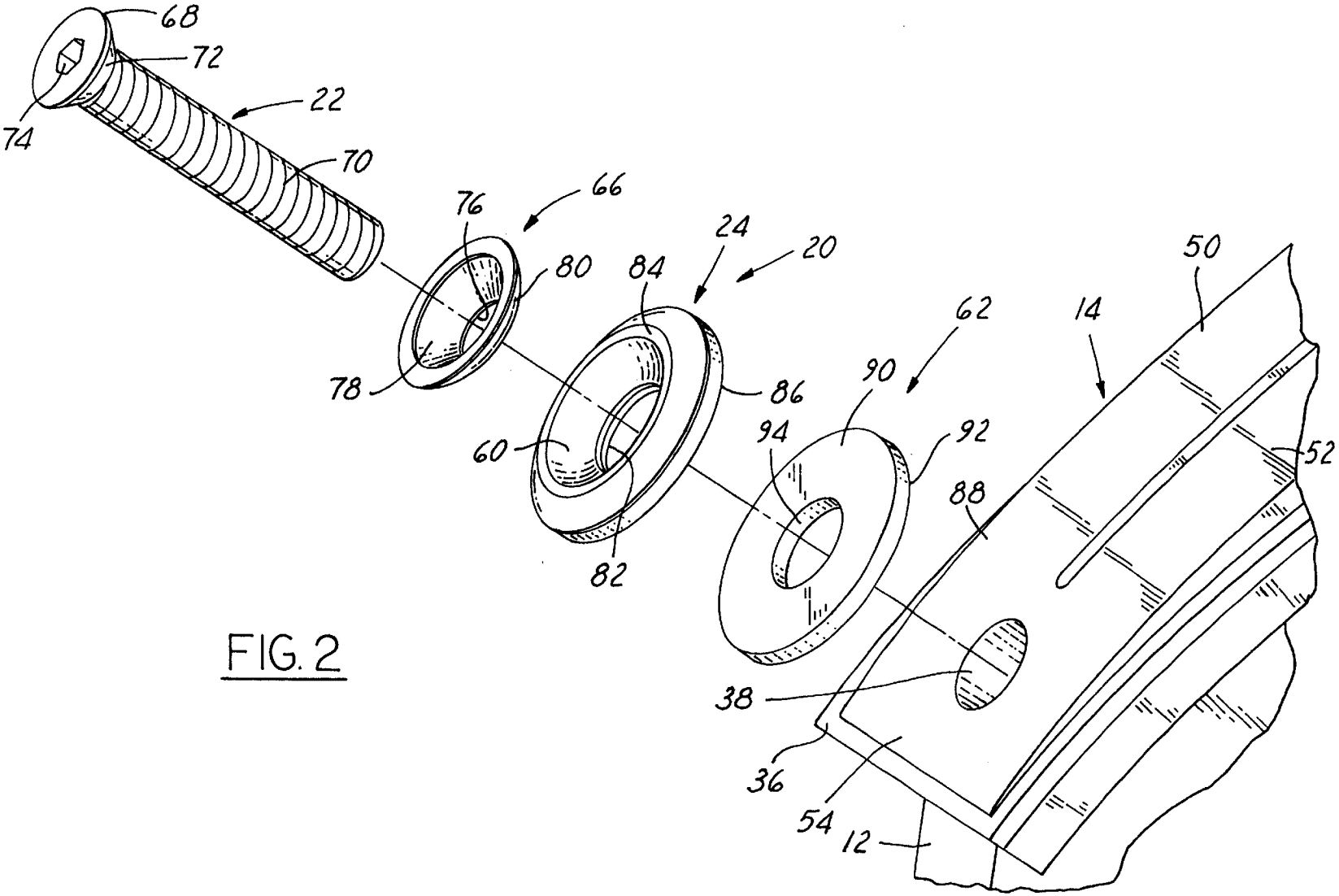
FIG. 2 in an exploded assembly view of the connector assembly for mounting a limb to the riser of the bow.
Figure 4:
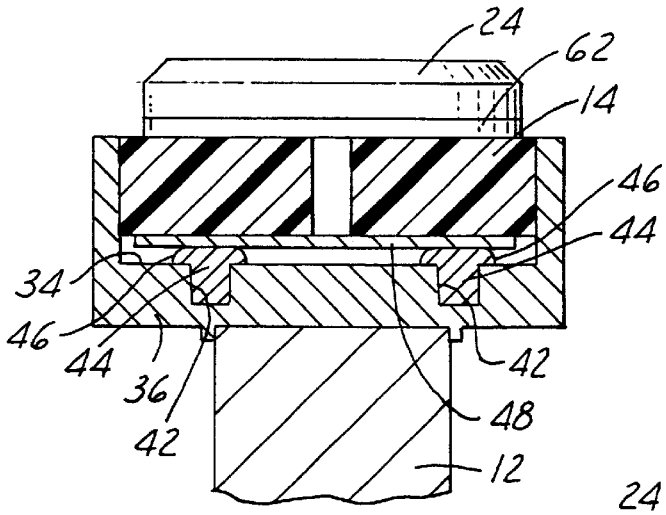
FIG. 4 is an enlarged fragmentary sectional view taken generally along line 4—4 of FIG. 1.

As shown in more detail in FIGS. 2–4, each limb 14, 16 is received in a complementary and generally rectangular pocket 34 formed in a block 36 attached to or integral with the riser 12 with aligned bores 38, 40 through the limb and the pocket, respectively, to receive the cap screw 22 therethrough. As shown in FIG. 4, the block 36 may have blind bores 42 open to the pocket with a dowel 44 having an enlarged dome shaped head 46 received in each blind bore 42. A pivot plate 48 disposed between each limb 14, 16 and its associated dowels 44, defines a fulcrum or support about which the limbs 14, 16 are flexed.

Each limb 14, 16 may be a single, unitary body, may comprise two limb pieces completely separate from each other and retained by the same connector assembly or may be a split limb, as shown in FIG. 2, with a pair of substantially separate limb pieces 50, 52 integral with the other at one end 54. In any form, each limb 14, 16 may be retained by one connector assembly 20 as described hereinafter. The aligned bores 38, 40 through each limb and its associated pocket 34 lead to a threaded blind bore 56 in the riser 12, which threadably receives the cap screw 22 of the connector assembly 20.

In more detail, the connector assembly 20 has a connector such as a cap screw 22, a first washer 24 with a sliding surface embodied as a concave recess 60 permitting pivotal movement of the first washer 24 relative to the cap screw 22 and preferably a second washer 62 disposed between the first washer 24 and the limb 14, 16 of the bow 10. Also preferably, an insert 66 is disposed between a head 68 of the cap screw 22 and the first washer 24 to facilitate pivotal movement of the first washer 24 relative to the cap screw 22.

The cap screw 22 has a threaded shank 70 and the enlarged head 68 at one end of the shank with a generally frustoconical or tapered sidewall 72 extending from the shank 70. The tapered sidewall 72 is complementary in shape to an inner surface of the insert 66 provided between the cap screw 22 and the first washer 24. A socket 74 in the head 68 is adapted to receive a tool to turn or drive the cap screw 22.

The insert 66 is annular with a through bore 76 and is generally frustum shaped with an inner tapered, generally concave or conical surface 78 complementary in shape to the tapered conical surface 72 of the cap screw 22 and an outer surface 80 generally complementary in shape to the recess 60 of the first washer 24 defining a preferably semi-spherical guide surface about which the first washer 24 pivots. The insert 66 is preferably light weight to reduce the overall weight of the bow 10 and may be formed of substantially any material including polymers such as thermoplastics and thermosets, ceramics, metals or other materials, and may be coated with a material such as polytetrafluoroethylene or a non-solid lubricant to reduce sliding friction between adjacent components and the insert 66. Preferably, the insert 66 is formed of brass, or Delrin AF.

The first washer 24 is annular with a through bore 82 and has the concave recess 60 open to one face 84 and leading to the through bore 82. The recess 60 is preferably arcuate and complementary to a generally semi-spherical surface. The sidewall is circumferentially continuous to permit pivoting of the first washer 24 relative to the cap screw 22 in substantially any direction. A bottom face 86 of the first washer 24 is planar and is disposed on a flat upper face 88 of its limb 14,16 or on a flat upper face 90 of the second washer 62 disposed between it and the limb 14, 16, if desired. The first washer 24 may be formed of substantially any metal such as steel or aluminum, various plastics, ceramics and/or may be coated with polytetraflouraetheylene, grease or some other material to reduce friction between it and the insert 66 or cap screw 22, if no insert 66 is used.

The second washer 62 is annular and has opposed flat faces 90, 92 with a through bore 94 aligned in assembly with the bores of the insert 66, first washer 24 and riser 12 to receive the cap screw 22. The upper flat face 90 is seated against the lower flat face 86 of the first washer 24 and the lower flat face 92 of the second washer 62 is seated on the flat upper face 88 of the limb 14, 16. The second washer 62 may be formed of substantially any material and is preferably light weight to avoid adding any significant weight to the bow. Additionally, the second washer 62 may be formed of a resilient, elastomeric synthetic rubber or other ductile material to dampen vibrations in the bow 10.

In use, as the bow 10 is assembled, a limb 14, 16 is disposed in a pocket 34 of one of the blocks 36 on the riser 12 such that the bore 38 through the limb 14, 16 (or gap between two separate limb portions) aligns with the bore 40 through the pocket 34 and the blind bore 56 in the riser 12. The cap screw 22 is inserted through the insert 66, first washer 24, second washer 62, the bore 38 of the limb 14, 16, the bore 40 of the pocket 34 and is threaded into the blind bore 56 in the riser 12. The cap screw 22 is initially fully tightened to firmly trap the end 54 of the limb 14, 16 between the second washer 62 and the pocket 34.

After the other limb 14, 16 is assembled in the same manner, the riser 12 with attached limbs 14, 16 may be placed into a bow press to flex the limbs to facilitate attaching and routing the string or strings 30 of the bow 10 to the cams, wheels or limbs in a conventional manner and as appropriate for the particular bow 10 being assembled. When removed from the bow press, the limbs 14, 16 may extend slightly but preferably remain under tension even at the fully at rest position of the bow 10 as shown in FIG. 1 to define a first orientation of the end of the limb 14, 16 relative to the block 36, the dowels 44 therein and the pivot plate 48 and an initial preloading or flex of the limbs.

With each cap screw 22 fully tightened, the bow 10 is set for its maximum draw weight for the particular string length and configuration as assembled. To adjust t the draw weight of the bow 10, the cap screws 22 may be backed out from their fully tightened position to change the orientation of the ends 54 of the limbs 14, 16 relative to the block 36 and riser 12 and thereby reduce the degree to which the limbs are flexed and hence, reduce the stress on the limbs. Desirably, as the orientation of the ends 54 of the limbs 14, 16 changes, each second was her 62 remains flush against its limb 14, 16 and each first washer 24 remains flush against its second washer 62 so that the orientation of the second washer 62 and first washer 24 change relative to their corresponding cap screw 22 while the cap screws 22 remain axially aligned with their blind bores 56 to limit the side, lateral, non-axial forces or shearing forces applied to the cap screws 22. In this manner, each cap screw 22 may be backed out to a relatively large extent thereby changing the orientation of the limb 14, 16 relative to the block 36 and permitting the draw weight of the bow 10 to be changed over a considerable range. Notably, in one exemplary embodiment, the draw weight of the bow 10 can be changed by about 20 to 30 pounds without compromising the integrity of the cap screw itself or the integrity of the connection between the cap screw 22 and the riser 12. Therefore, the archer has a tremendous ability to significantly vary the draw weight of a single bow without disassembly or other servicing of the bow. This same advantage permits manufacture of fewer bows with different draw weights as any one bow can readily have its draw weight changed over a wide range.

As shown in FIG. 3, the shank 70 o f the cap screw 22 is closely received in the bore 76 of the insert 66. With this construction, the first washer 24 pivots or swivels relative to the insert 66 which remains substantially aligned with the cap screw 22. It may also be possible to provide a larger bore 76 through the insert 66 providing a gap between the shank 70 of the cap screw 22 and the insert 66 so that the insert pivots at least slightly relative to the cap screw 22 along with the pivotal movement of the first washer 24. In either embodiment, the cap screw 22 remains substantially stationary and does not bend or pivot relative to the blind bore 56 of the riser 12 in which it is received to prevent excessive stress on the cap screw 22 which may cause it to fail or break in use.

Figure 5:
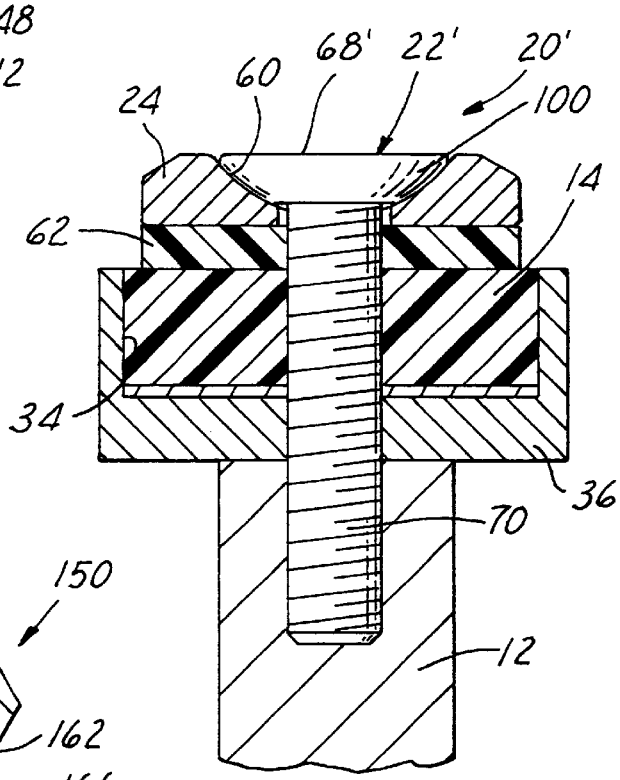
FIG. 5 is an enlarged fragmentary sectional view of an alternate embodiment of a connector assembly.

As shown in FIG. 5, an alternate embodiment connector assembly 20' is constructed in substantially the same manner as the connector assembly 20 except no insert 66 is provided. Instead, the cap screw head 68' has an integral guide surface 100 disposed in and complementary in shape to the sliding surface, shown as recess 60 in the first washer 24 to permit the first washer 24 to pivot relative to the cap screw 22'. The connector assembly 20' functions in the same manner as the connector assembly 20 and hence, will not be described further.

Figure 6:
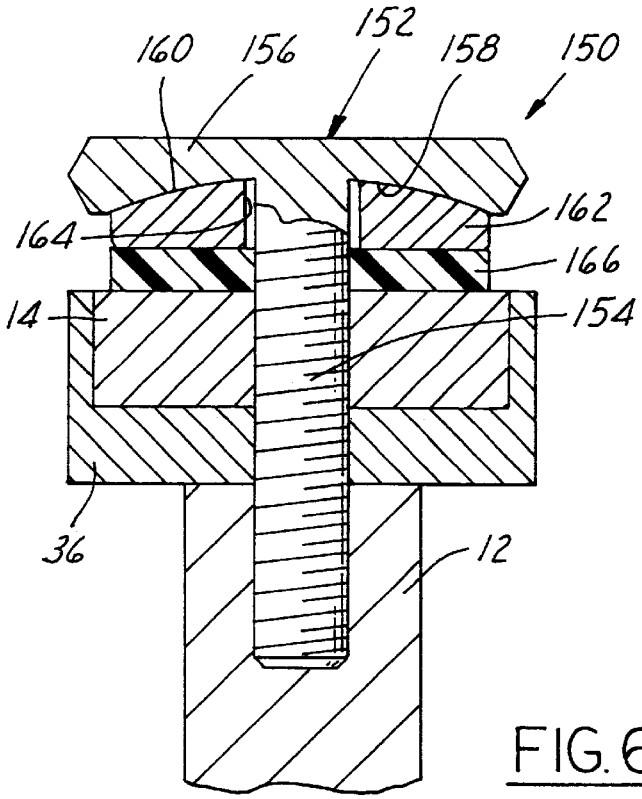
FIG. 6 is an enlarged fragmentary sectional view of another alternate embodiment of a connector assembly.

As shown in FIG. 6, another alternate embodiment connector assembly 150 has a cap screw 152 with a shank 154 and a head 156. The head 156 has a generally concave guide surface 158 which is complementary to a generally convex sliding surface 160 of a first washer 162 disposed between the limb 14 and head 156. A through bore 164 of the first washer 162 is oversized relative to the shank 154 to permit the first washer 162 to pivot relative to the cap screw 152 as the draw weight of the bow is changed as described herein. A second washer 166 may be disposed between the first washer 162 and limb 14 as in the other embodiments.

In any form, the orientation of each limb 14, 16 and its corresponding second washer 62,166 and first washer 24,162 can be changed relative to the cap screw 22,152 and the riser 12 to permit the draw weight of the bow 10 to be changed or varied over a wide range without significantly affecting the integrity of the connection of the limb 14, 16 to the riser 12 by the cap screw 22,152. Desirably, the guide surface 80,100 or 158 and sliding surface 60,160 of the connector assembly 20,20', 150 can have substantially any size, shape or orientation which permits the limb, first washer and second washer, if any, to pivot relative to the cap screw 22,152 which remains essentially stationary and unbent in the blind bore of the riser. Thus, it will be appreciated by those skilled in the art that shapes other than the concave and convex sliding and guide surfaces may be utilized.

Notably, in prior bows having a cap screw extending into the riser and into a pivot block received in a bore formed in the riser, the cap screw engaged the riser itself over only a limited number of threads limiting the strength of the connection between them and providing a significant constraint to the adjustment of the draw weight of the bow. In this embodiment, the blind bore 56 is preferably fully threaded and even when the cap screw 22,152 is significantly backed off from its fully tightened position to reduce the draw weight of the bow 10, the cap screw 22,152 has a sufficient number of threads received in the blind bore 56 of the riser 12 to maintain a strong connection between the cap screw 22,152 and riser 12. Further, as mentioned above, the integrity of the connection between the cap screw 22,152 and the riser 12 is maintained according to the present invention by pivoting the washers 24,162 and 62,166 relative to the cap screws 22,152 rather than pivoting the cap screws 22,152 relative to the riser 12 as is done with a cylindrical pin arrangement. If desired, a connector assembly 20,20', 150 of similar construction can be used to mount other items to the bow such as, for example, bow 10 accessories such as sights, quivers, overdraws, rests or stabilizers.

What is claimed is:

1. A connector assembly for an archery bow, comprising:

a connector having a shank and a head fixed to one end of the shank;

a first washer having a generally semi-spherical sliding surface on one face and a through bore to receive the shank of the connector in assembly, with the first washer disposed between the head of the connector and an object being connected to the bow in assembly; and a generally semi-spherical guide surface on the head of the connector received adjacent to and complementary in shape to the sliding surface of the first washer to permit the first washer to pivot relative to the connector as the orientation of the object connected to the bow is changed.

2. The assembly of claim 1 wherein the guide surface is integral with the head of the connector.

3. The assembly of claim 1 which also comprises a second washer having opposed planar faces disposed between the first washer and the object connected to the bow.

4. The assembly of claim 3 wherein the second washer is formed of a polymeric material.

5. The assembly of claim 1 wherein the sliding surface is concave.

6. A connector assembly for an archery bow, comprising:

a connector having a shank and a head at one end of the shank;

a first washer having a sliding surface on one face and a through bore to receive the shank of the connector in assembly, with the first washer disposed between the head of the connector and an object being connected to the bow in assembly; and an insert disposed between the head of the connector and the first washer and defining a guide surface received adjacent to and complementary in shape to the sliding surface of the first washer to permit the first washer to pivot relative to the connector as the orientation of the object connected to the bow is changed.

7. The assembly of claim 6 wherein the insert is annular and generally frustum shaped with an inner face having a generally concave, circumferentially continuous sidewall to closely receive an adjacent portion of the head of the connector and an outer surface to be closely slidably received adjacent to the sliding surface of the first washer.

8. The assembly of claim 6 wherein the insert is formed of a polymeric material.

9. The assembly of claim 6 wherein the insert is coated to reduce friction between it and the first washer.

10. A connector assembly for an archery bow, comprising:

a connector having a shank and a head at one end of the shank;

a first washer having a generally semi-spherical sliding surface on one face and a through bore to receive the shank of the connector in assembly, with the first washer disposed between the head of the connector and an object being connected to the bow in assembly;

a generally semi-spherical guide surface received adjacent to and complementary in shape to the sliding surface of the first washer to permit the first washer to pivot relative to the connector as the orientation of the object connected to the bow is changed; and a second washer having opposed planar faces disposed between the first washer and the object connected to the bow with one face flush against the first washer and the other face generally flush against the object connected to the bow.

11. A connector assembly for an archery bow, comprising:

a connector having a shank and a head fixed to one end of the shank;

a first washer having a convex sliding surface on one face and a through bore to receive the shank of the connector in assembly, with the first washer disposed between the head of the connector and an object being connected to the bow in assembly; and a guide surface on the head of the connector received adjacent to and complementary in shape to the sliding surface of the first washer to permit the first washer to pivot relative to the connector as the orientation of the object connected to the bow is changed.

12. An assembly for connecting a limb to a riser of an archery bow, comprising:

a connector having a head at one end and a threaded shank integral with the head and adapted to be received in a threaded blind bore in a riser of an archery bow;

a first washer having a semi-spherical sliding surface and a through bore to receive the shank of the connector in assembly, with the first washer disposed between the head of the connector and a limb being connected to the bow in assembly; and a semi-spherical guide surface received adjacent to and complementary in shape to the sliding surface of the first washer to permit the first washer to pivot relative to the connector as the orientation of the limb connected to the bow is changed.

13. The assembly of claim 12 wherein the guide surface is integral with the head of the connector.

14. The assembly of claim 12 which also comprises a second washer disposed between the first washer and the limb connected to the bow and formed of a material suitable to dampen vibrations at the second washer.

15. An assembly for connecting a limb to a riser of an archery bow, comprising:

a connector having a head at one end and a threaded shank adapted to be received in a threaded blind bore in a riser of an archery bow;

a first washer having a sliding surface and a through bore to receive the shank of the connector in assembly, with the first washer disposed between the head of the connector and a limb being connected to the bow in assembly; and an insert disposed between the head of the connector and the first washer and defining a guide surface received adjacent to and complementary in shape to the sliding surface of the first washer to permit the first washer to pivot relative to the connector as the orientation of the limb connected to the bow is changed.

16. The assembly of claim 15 herein the insert is coated to reduce friction between it and the first washer.

17. The assembly of claim 15 wherein the sliding surface and guide surface are semi-spherical.

18. A compound archery bow, comprising:

a riser having a pair of ends, and a threaded blind bore adjacent to each end;

a pair of limbs each extending from a separate end of the riser; and a pair of connector assemblies each releasably and adjustably connecting a separate limb to the riser and each having a connector with a threaded shank received at least in part in an associated blind bore in the riser and an enlarged head fixed to one end of the shank, a first washer disposed between the connector head and the limb with a semi-spherical sliding surface, and a semi-spherical guide surface on the connector head received against and complementary in shape to the sliding surface of the first washer to permit the first washer to pivot relative to the connector when the orientation of its associated limb relative to the riser is changed by moving the connector relative to the riser.

19. The bow of claim 18 wherein the guide surface is integral with the head of the connector.

20. An archery bow, comprising:

a riser having a pair of ends, and a threaded blind bore adjacent to each end;

a pair of limbs each extending from a separate end of the riser;

a pair of connector assemblies each releasably and adjustably connecting a separate limb to the riser and each having a connector with a threaded shank received at least in part in an associated blind bore in the riser and an enlarged head at one end of the shank, a first washer disposed between the connector head and the limb with a semi-spherical sliding surface, and a semi-spherical guide surface received against and complementary in shape to the sliding surface of the first washer to permit the first washer to pivot relative to the connector when the orientation of its associated limb relative to the riser is changed by moving the connector relative to the riser; and an insert disposed between the head of the connector and the first washer and defining the guide surface.

* * * * *